United States Patent [19]

Sawdon

[11] Patent Number: 4,878,284

[45] Date of Patent: Nov. 7, 1989

[54] HAND HELD SHEET METAL JOINING SYSTEM

[75] Inventor: Edwin G. Sawdon, St. Clair, Mich.

[73] Assignee: BTM Corporation, Marysville, Mich.

[21] Appl. No.: 139,976

[22] Filed: Dec. 31, 1987

[51] Int. Cl.[4] ..... B23P 11/00; B23P 19/00

[52] U.S. Cl. ..... 29/243.53; 29/505; 29/432; 29/796; 29/DIG. 54; 29/437

[58] Field of Search ..... 29/243.53, 400 D, 421 R, 29/505, 428, 432, 796, DIG. 54, 437

[56] References Cited

U.S. PATENT DOCUMENTS

| | | | |
|---|---|---|---|
| 3,615,274 | 10/1971 | Belada | 29/432 |
| 3,900,937 | 8/1975 | Schleicher | 29/432 |
| 3,981,064 | 9/1976 | Hafner | 29/432 |
| 4,459,735 | 7/1984 | Sawdon | 29/509 |
| 4,574,453 | 3/1986 | Sawdon | 29/432 |
| 4,574,473 | 3/1986 | Sawdon | 29/798 |
| 4,607,418 | 8/1986 | Hafner | 29/432 |
| 4,722,647 | 2/1988 | Sawdon | 411/180 |
| 4,757,609 | 7/1988 | Sawdon | 29/432 |

*Primary Examiner*—Bruce Y. Arnold
*Assistant Examiner*—Ronald M. Kachmari
*Attorney, Agent, or Firm*—Harness, Dickey & Pierce

[57] ABSTRACT

A portable sheet metal joining apparatus is disclosed including a releasable tool carrying cartridge carried by a piston in a hand held gun which is powered by a booster of very compact design which uses standard compressed air to create high pressure hydraulic fluid to activate the gun.

30 Claims, 8 Drawing Sheets

52
54
48
30
50
58
86
64
D
38
102
44
42
78
84
56
60
16
72
104
106
76
74
100
40
80
62
98
82
34
32
C
66
98
E
96
110
118
12
26
114
68
108
120
A
28
B
36
14
46
10

HAND HELD SHEET METAL JOINING SYSTEM

This invention generally relates to metal working apparatus such as for joining overlapping plates, and more particularly to a hand held system including a fluid pressure booster for using a low pressure fluid to create a high pressure fluid and a hand held punch apparatus driven by the high pressure fluid for deforming the plates whereby to form a metal joint therebetween.

Joining pieces of sheet metal by manipulating same to cause them to be deformed into an interlocked relationship in a localized area is shown in U.S. Pat. No, 4,459,735. Such apparatus conveniently joins sheet of metal and also provides the user with a leakproof joint.

In an addition to providing such a joint between two or more sheet material items, it is desirable to have a material joining apparatus which is portable, compact in its design such that it does not take up an undue amount of space, simple in its arrangement for inserting or removing the punch such as for different applications, inspection or when worn, useful in assembly areas supplying fluids such as compressed air at a relatively low pressure but capable of converting the low pressure to an extremely high output pressure ordinarily required to drive a punch, and compatible for incorporation into robotic applications. Additionally, it is advantageous to have a punch apparatus that is rapidly adjustable, whereby the user can inspect the quality of a joint so formed and then be able to adjust punch penetration to produce a leakproof joint, as well as one which can also be used for regular punching, riveting or stamping operations.

These features and others are provided by the apparatus of the present invention as described hereinbelow and shown in the accompanying drawings, in which.

Figure 1:
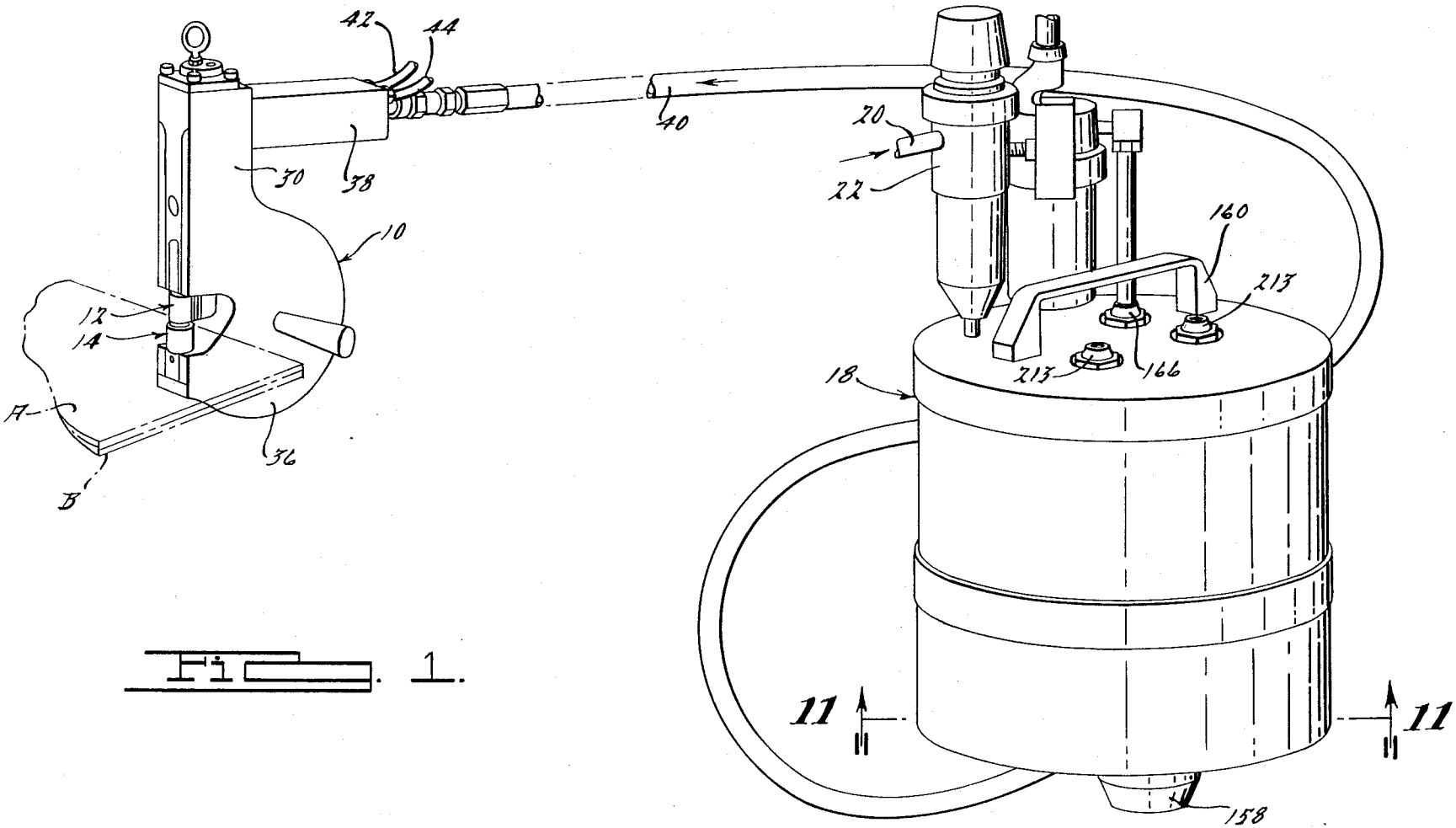
FIG. 1 is a perspective view of a portable hand held sheet metal joining system according to the invention.
Figure 2:
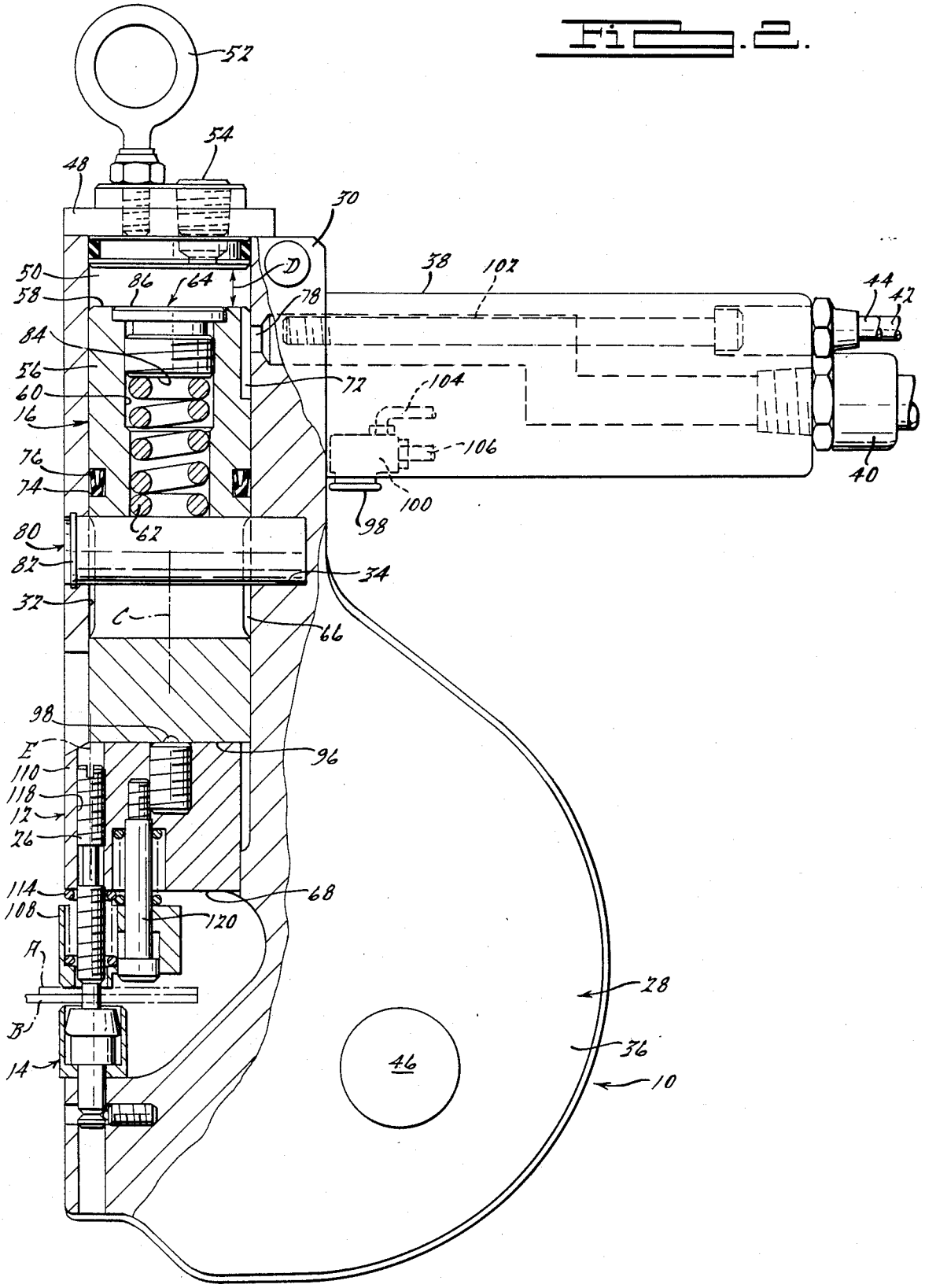
FIG. 2 is a side elevational view partly in section of the hand held gun of the system shown in FIG. 1.
Figure 3:
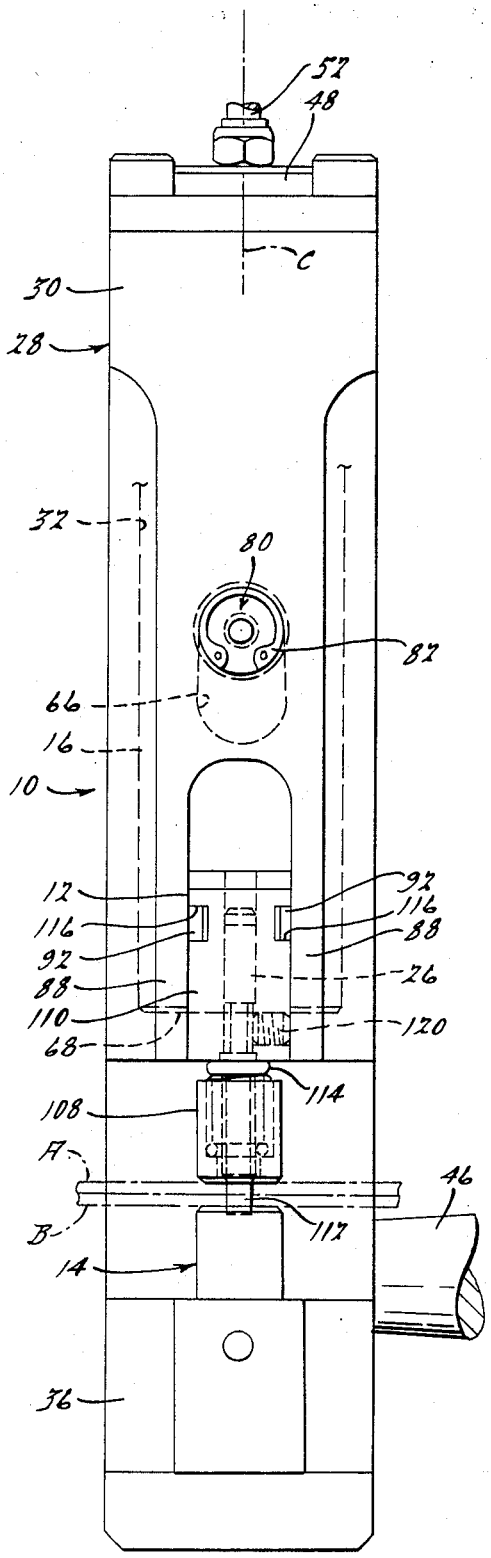
FIG. 3 is a front elevation view of the hand held gun.
Figure 4:
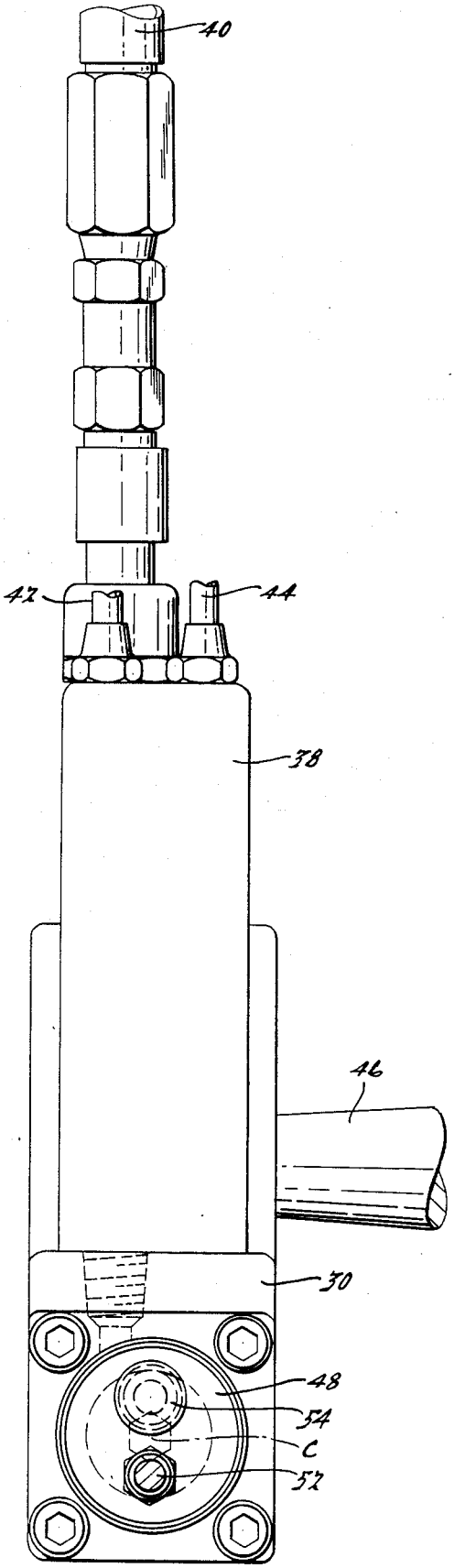
FIG. 4 is a top plan view of the hand held gun.
Figure 5:
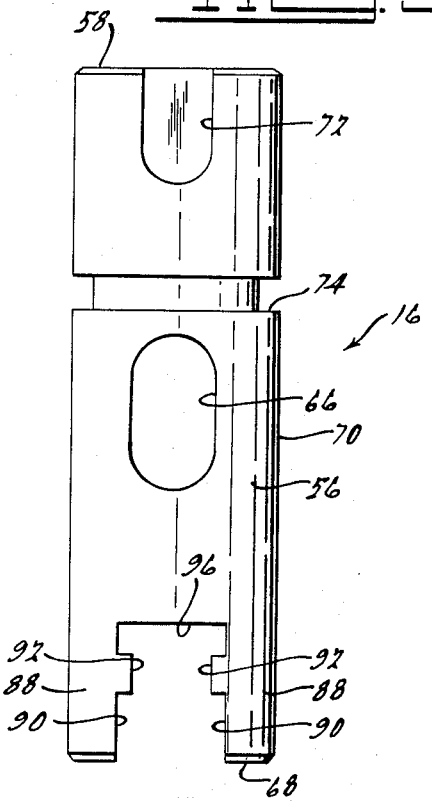
FIGS. 5–7 are front, top and bottom views of a piston mounted in the hand held gun.
Figure 6:
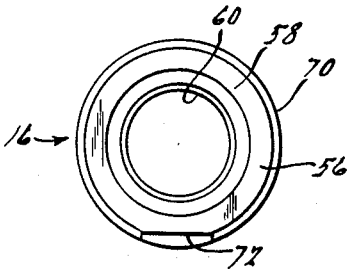
Figure 7:
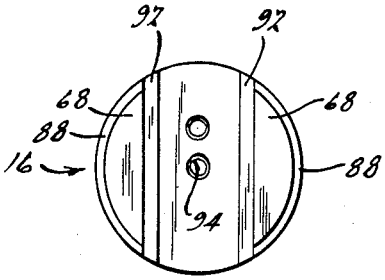
Figure 8:
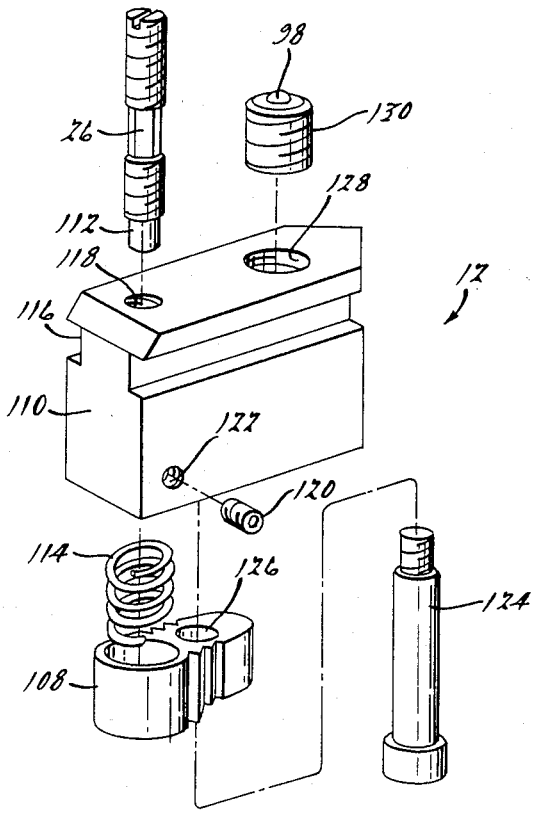
FIG. 8 is an exploded perspective view of a punch holder assembly removably insertable in the piston shown in FIGS. 5–7.
Figure 9:
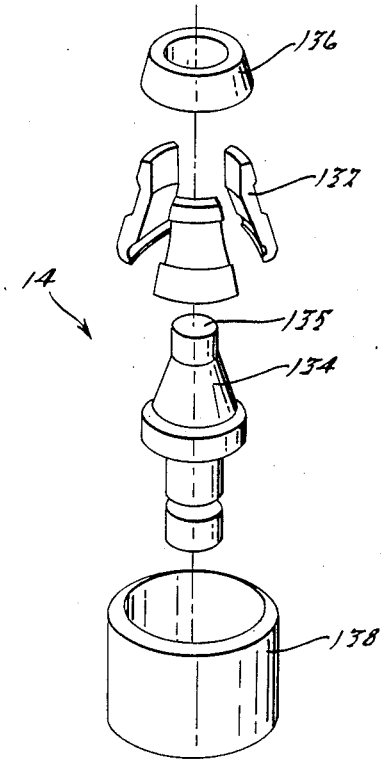
FIG. 9 is an exploded view of a die assembly removably insertable in the hand held gun.
Figure 10:
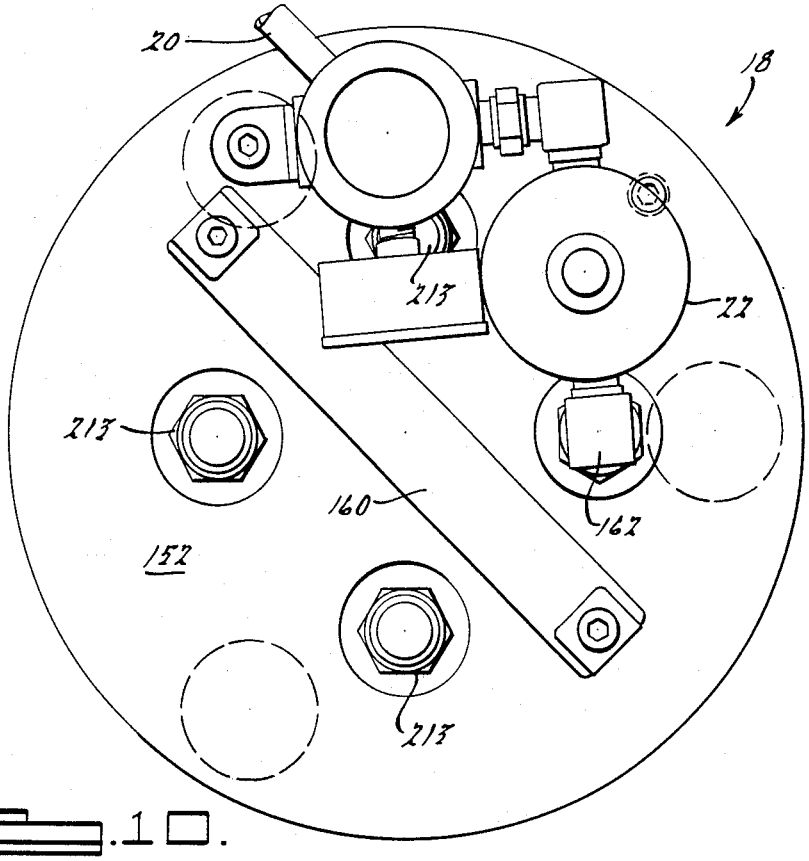
FIG. 10 is a top plan view of the power booster of the system shown in FIG. 1.
Figure 11:
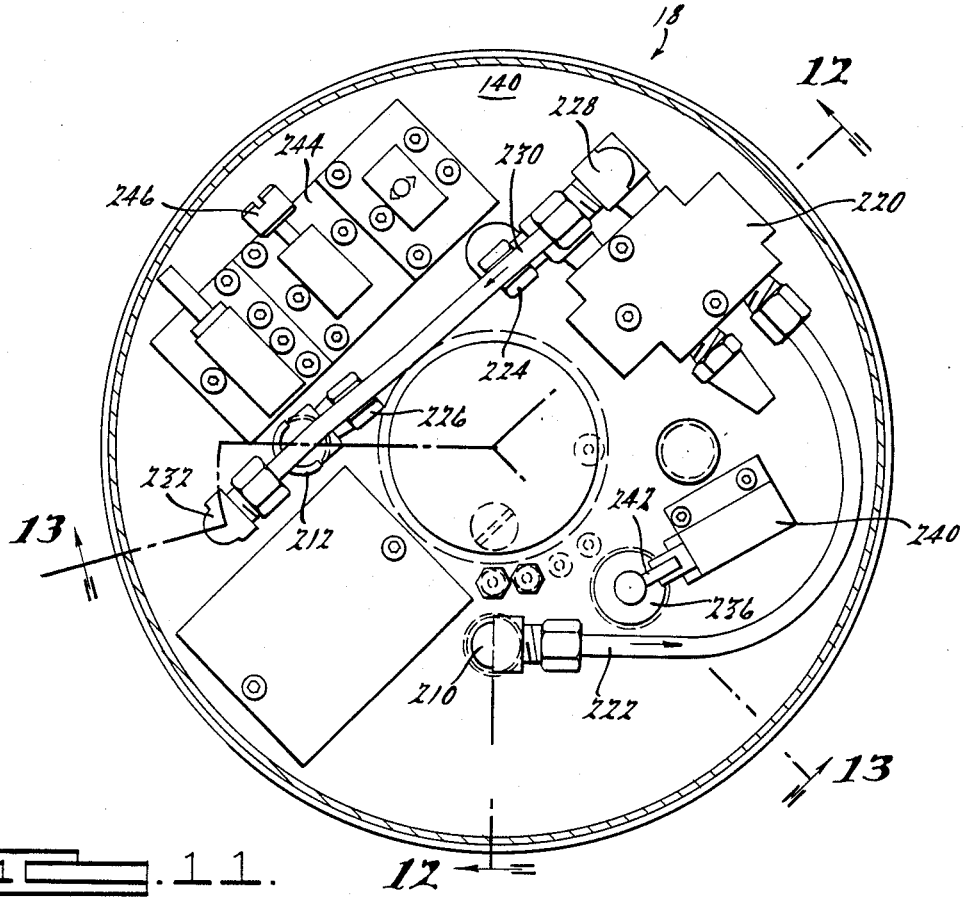
FIG. 11 is a section view looking upwardly generally along line 11—11 in FIG. 1.
Figure 12:
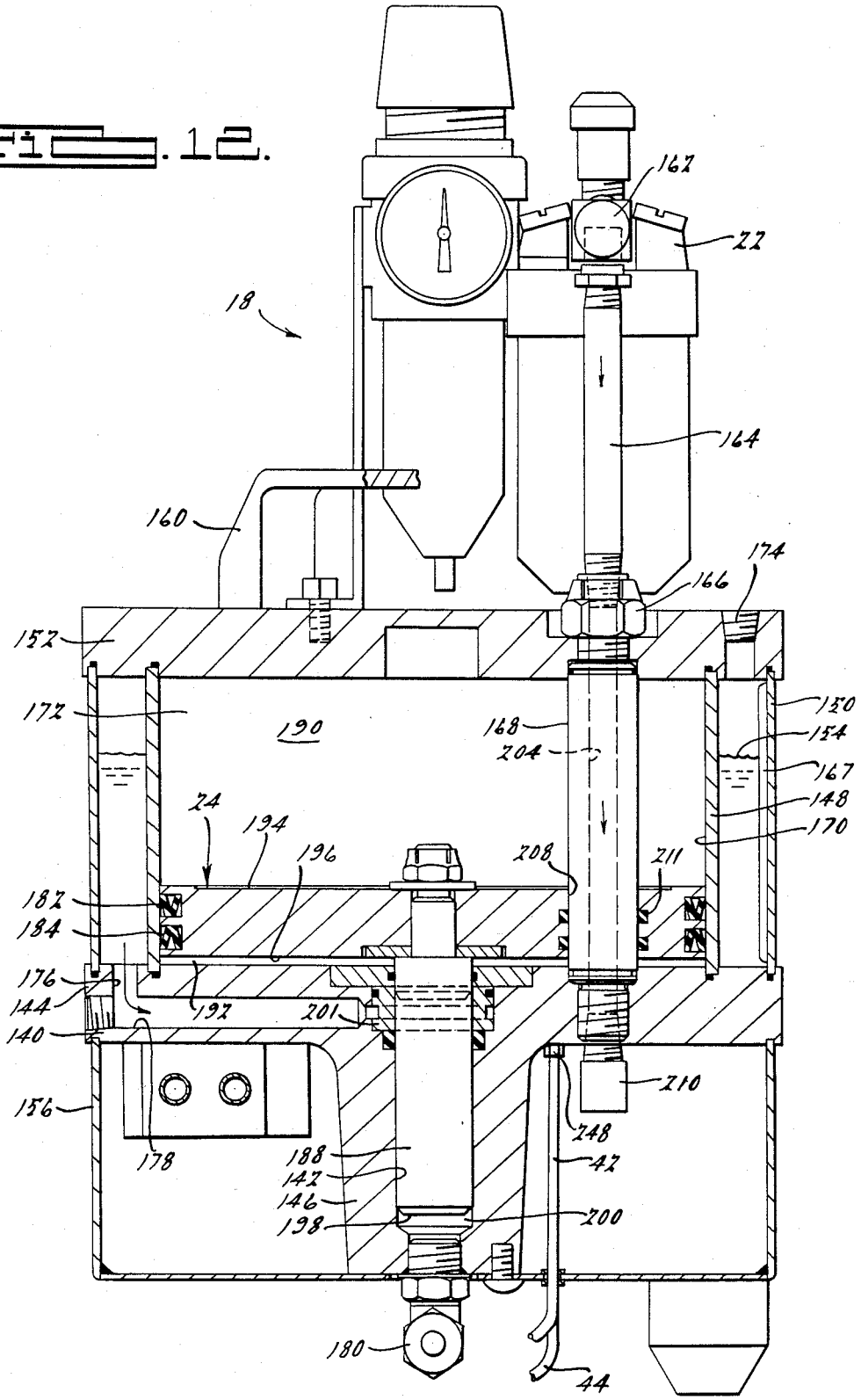
FIG. 12 is a section view of the booster taken along line 12—12 of FIG. 11.

The sheet metal joining system of the present invention generally comprises a hand held gun 10 including a punch assembly 12, a die assembly 14 for joining sheet material "A" and "B" disposed between the assemblies, a piston 16 drivingly connected to the punch assembly and a power booster 18 which receives compressed air supplied from a source (not shown) at low pressure through a hose 20 connected to a conventional filter-regulator-lubricator 22 on top of booster 18. The compressed air causes a booster piston 24 to advance and boost low pressure oil in the booster to a high pressure and supplies this high pressure oil to hand gun 10 whereby to activate the gun piston 16 to drive a punch 26 in punch assembly 12 towards die assembly 14 to locally deform the sheet material disposed therebetween. FIGS. 1–3 show sheets "A" and "B" in phantom and punch 26 in its advanced position. The piston stroke is indicated at "D" (FIG. 2).

Although only two pieces of sheet metal are shown it is to be understood that more than two pieces may be joined, depending on sheet thickness and/or sheet material. The joint so formed, and the method and apparatus for forming it, are shown and described in the hereinabove referenced U.S. Pat. No. 4,459,735, and in applicant's copending application for U.S. patent Ser. No. 853,130, filed Apr. 17, 1986, entitled Apparatus and Method for Joining Sheet Material and Joint Formed Thereby, the disclosure of both of which are expressly incorporated herein by reference.

Hand held gun 10 comprises a housing 28 including an upper portion 30 (as shown) having an axial bore 32 concentric with a enter axis "C", a blind transverse bore 34, a generally C-shaped lower portion 36 defining a work space for receiving the sheets to be joined, an enclosure or shroud 38 extending transversely from the upper portion for receiving oil and air supplied by hoses 40 and 42, respectively, from the power booster 18 and for returning air to the booster through hose 44, and a handle 46 extending outwardly from portion 36 to allow the user to hold and control the gun position. Bore 32 extends between a top opening and a bottom opening in portion 30 and receives piston 16 for axial reciprocation therewithin. A cap 48 closes the top opening to define an oil reservoir 50 between the cap and the piston. In some uses cap 48 could include an eye bolt 52 extending upwardly from the top thereof for supporting the hand gun in the work area. Also, instead of the oil being supplied through enclosure 38, the cap could include a port for supplying high pressure oil directly to oil reservoir 50. As shown, the port in the cap is closed by threaded plug 54.

The piston 16 has a generally axially extending cylindrical body 56 having an upper end 58 (as shown), a partially threaded bore 60 extending from the upper end, a coil spring 62 sized to fit into the bore, a threaded plug 64 for closing bore 60 whereby to captivate the coil spring therewithin, an axial slot 66 medially of and extending radially through the body, and a clevis-like lower end 68. The outer surface of piston body 56 includes a groove 72 which extends axially inwardly from end 58, and a medial annular groove 74 for receiving an elastomeric seal 76 to prevent oil in reservoir 50 from leaking around the piston. Axial groove 72 communicates with a port 78 to supply oil into the reservoir 50.

A cylindrical retention pin 80 is inserted into bore 34 and through slot 66 in piston 16, and is retained in housing 28 by a retaining ring 82. Pin 80 serves several functions: to limit axial travel of the piston, to prevent the piston from rotating, to accurately position the piston and its axis "C" for reciprocation within the bore relative to the punch assembly 12 and an axis "E" of its punch 26, and to allow easy disassembly of the piston from the bore when desired.

Plug 64 has an inner end face 84 and an outer end face 86. When threadably secured into bore 60 of the piston end face 86 and the end of the piston defines part of reservoir 50. End face 84 engages one end of coil spring 62 whereby the coil spring is compressed against pin 80. The spring biases piston 16, and hence punch assembly 12, toward their retracted position.

Lower end 68 of piston 16 is generally U-shaped to define a pair of laterally spaced longitudinally extending gripping arms 88, each arm provided on its inside surface 90 with a transverse rib 92 for engaging and supporting punch assembly 12. A detent 94 is provided in end face 96 of the piston for cooperative retaining relationship with a spring biased lock ball 98 that protrudes from the punch assembly. Surfaces 90 and 96 define a recess for receiving punch assembly 12.

Enclosure 38 includes a trigger button 98, a trigger valve 100 actuated thereby, and conduits 102, 104 and 106 disposed therein. Conduit 102 receives the high pressure oil from hose 40 and transmits same to inlet port 78 which registers with axial groove 72 to deliver high pressure oil into reservoir 50, the oil acting on the outer end of the piston to drive piston 16 longitudinally from its retracted position to its second advanced position. Conduits 104 and 106 are operably connected between valve 100, controlled by trigger button 98, and conduits 42 and 44, respectively, in any suitable manner (not shown) for receiving compressed air from power booster 18 and, with operation of button 98, sending a compressed air control signal back to the power booster. Trigger 98 and valve 100, as an alternative, can be replaced with a standard electrical switch for control purposes, if desired, in which case hoses 42 and 44 would be replaced with wires.

Punch assembly 12, which is a removable generally rectangular cartridge includes a stripper 108, a punch holder 110 including a partially threaded punch 26 having an operating end portion 112, and a stripper coil spring 114 disposed around the punch and between the stripper and the punch holder. One feature of the present invention resides in the manner of mounting the punch assembly for easy removal, strength and constant alignment. The punch holder has a pair of lateral side walls each having a groove 116 therein sized to slidably interfit and receive a respective rib 92 from one piston arm. The distance between the side walls is slightly less than the lateral separation between inwardly facing surfaces 90 of arms 88 to permit insertion and removal, and ribs 92 prevent tilting of punch holder 110 about a horizontal axis (as shown) relative to the piston and uniformly transmit driving loads diametrically across the entire piston cross-section (note that punch axis "E" is axially aligned with die assembly 14 and is not outside the outside surface of piston 16, thus reducing turning moments). When the cartridge is fully inserted between the arms, punch holder 110 has its back face seated against the housing 28 and front face substantially flush with the front of the housing.

Punch holder 110 has a partially threaded throughbore 118 centered on axis "E" for threadably engaging the threaded portion of punch 26. End portion 112 of the punch is normally recessed in stripper 108 but is adapted upon actuation of the piston to be driven outwardly therefrom to punch the metal. A set screw 120 extends through a threaded bore 122 in one side wall of the holder for engaging and preventing rotation (and unwanted axial adjustment of the punch). A threaded guide bolt 124 passes through a bore 126 of the stripper and into a threaded bore (not shown) in the punch holder for securing the stripper to the punch holder adjacent to the bottom exposed surface thereof. The stripper functions in the normal manner. A threaded cavity 128 receives a threaded insert 130 enclosing a coil spring (not shown) for biasing lock ball 98 therein axially upwardly (as shown) so that a portion of the ball extends above the top surface for receipt within detent 94 in the piston.

Die assembly 14 is rigidly fixed in lower portion 36 of the housing and comprises a plurality of die blades 132 disposed about a dies body 134 having an anvil 135 and held in place by an elastomeric ring 136, the assembly being disposed within a blade shield 138. The details of this assembly are shown and described in copending application Ser. No. 853,130, filed Apr. 17, 1986, the specification of which is specifically incorporated herein by reference.

Punch assembly 12, piston 16 and die assembly 14 are mounted in the housing in a fixed relationship. Punch 26 has its center axis "E" disposed in a plane passing through center axis "C" of piston 16 but radially offset therefrom an amount approximately equal to but not greater than the radius of piston 16. The die assembly is sized to receive the end of punch 26 and defines a work piece supporting station for supporting the overlapping sheets of metal with the lowermost sheet "B" of metal being directly supported on the die assembly. When the piston 16 is actuated for reciprocating longitudinal movement along its axis "C" the bottom face of the stripper 108 is advanced and is pressed against the uppermost sheet "A" of metal. Further movement of the piston causes the punch to be driven against the sheets of metal whereby to draw a portion of the uppermost sheet of metal into the lowermost sheet of metal whereby they are both driven into the die opening and radially extruded to interlock the sheets together.

Power booster 18 comprises a cylindrical T-shaped frame 140 including a cylindrical bore 142 extending through cylindrical top and bottom portions 144 and 146, a pair of generally coaxially disposed cylindrical shells 148 and 150 each extending perpendicularly upwardly from circular slots (with seals) disposed in the top portion of the frame, which acts as a lower end plate, into similar slots (with seals) disposed in an upper end plate or lid 152 to define an annular oil reservoir 154 therebetween, a cylindrical closed shell 156 extending downwardly from the top portion of the frame and enclosing bottom portion 146 of the frame, a plurality of resilient feet 158 affixed to the bottom of shell 156 and a handle 160 affixed to lid 152. Compressed air at a relatively low pressure is supplied to the booster via a hose 20 connected to a conventional filter-regulator-lubricator 22 atop lid 152 which supplies same to a fitting 162 at the inlet of a conduit 164, this conduit being connected by a fitting 166 to lid 152 and a feed tube 168 therein. A sight glass 167 may be provided for reservoir 154.

Inner shell 148 has a surface 170 which in combination with lid 152 and frame 140 defines a closed compression cylinder 172 for receiving compressed air. A threaded inlet 174 in lid 152 is provided to fill reservoir 154 with oil. An inlet port 176 in top portion 144 communicates low pressure oil from reservoir 154, through a passage 178 extending radially through top portion 144, into a pumping bore 142. High pressure oil is discharged from bore 142 through a threaded fitting 180 into hose 40 leading to gun 10.

A cylindrical, T-shaped booster piston 24 is mounted for reciprocation in cylinder 172 and bore 142 and includes seals 182 and 184 and coaxial first and second piston portions 186 and 188 which move together, with first piston portion 186 defining an upper cylinder 190 and a lower cylinder 192. The first piston portion 186 is operated by compressed air supplied into the upper and lower cylinders and has an upper surface 194 defining a first surface area and a lower surface 196 defining a second surface area. Second piston portion 188 has a lower surface 198 which is much smaller in area than surfaces 194 and 196 so that it acts as an intensifier, increasing the pressure of the oil in bore 142 significantly over that of the air in cylinder 190. As first piston portion 186 rises in cylinder 172 second portion 188 rises in bore 142. A chamber 200 is defined below surface 198 in bore 142 and when the piston is at the top of its stroke passage 178 is opened whereby oil passes from reservoir 154 to fill chamber 200. High pressure sealing means 201 is disposed in frame 140 between the high and low pressure chambers. Compressed air supplied to upper cylinder 190 at a relatively low pressure causes piston portion 188 to move downwardly, closing passage 178, to boost the oil in chamber 200 to a relatively high pressure for driving piston 16 in hand gun 10.

In accordance with the invention booster 18 has dual-function cylindrical fastener tubes 168 and 202 which not only help hold the apparatus together against the force of the compressed air, but also serve as air feed passages to render the apparatus more compact. The tubes have respective central bores 204 and 206 adapted to pass air and extend through respective bores 208 and 209 in piston 24, the respective lower ends of each tube being threadably connected to frame 140 with an appropriate seal, the respective upper ends passing through an opening (with seal) in lid 152 and threadably engaging fitting 166 (which acts as a nut to clamp the apparatus together) in the case of tube 168 and a nut 213 in the case of tube 202. Seals 211 prevent undesired leakage through bores 208 and 209. Two additional similarly disposed cylindrical fastener rods (not shown) symmetrical with tubes 168 and 202 and having nuts 213, but not providing fluid passages, cooperate with tubes 168 and 202 to hold the structure together. Tube 168 passes air from conduit 164 connected to lid 152 by fitting 166 through cylinder 172 to a fitting 210 on frame 140. Tube 202 passes air from a fitting 212 on frame 140 to a discharge port 214 for supplying air into upper cylinder 190. A fitting 216 in frame 140 supplies air into lower cylinder 140 through a passage 218 in frame 140.

A 4-way power valve 220 disposed on frame 140 and receiving air from fitting 210 and host 222 controls whether air is to be supplied to upper cylinder 190 or lower cylinder 192. A fitting 224 on valve 220 communicates air therefrom through a hose 226 to fitting 212 for supplying air through tube 202 to upper cylinder 190, and a fitting 228 on valve 220 communicates air therefrom through a hose 230 to fitting 232 for supplying air through passage 218 to lower cylinder 192. As noted, when air is supplied to the lower cylinder, the booster piston retracts upwardly and hydraulic chamber 200 fills with oil. Conversely when air is supplied to upper cylinder the booster piston advances downwardly, closing pasasge 178 and pressurizing oil in chamber 200. A recess 234 is disposed in upper surface 194 about bore 209 in chamber 200. A recess 234 is disposed in upper surface 194 about bore 209 to ensure that discharge port 214 is not blocked off when the piston is fully retracted.

A limit rod 236 is rigidly secured to piston 24 and extends downwardly through a sealed bore 238 in frame portion 140 and is operably connected to a limit valve 240 having a follower 242 for determining piston position based on the position of rod 236. Valve 240 activates a timer 244 (having adjustment control 246) which in turn controls valve 220 in the usual manner (not shown) to assure that once gun piston travel has been initiated it will continue for a full stroke before retracting, in order that proper metal deformation takes place. Fittings 248 connect to the compressed air control lines 42 and 44 which sense the position of trigger 98 and are connected in the usual manner to valve 244 so that it can operate in response to trigger position.

In one application, hand gun 10 was approximately 8 pounds (3.6 kg), power booster 18 was approximately 35 pounds (25 kg), compressed air was supplied to the booster at about 80 psi (5.5 bar) and the output pressure of the hydraulic oil was about 3,800 psi (262 bar) to drive the gun piston. Advantageously, punch assembly 12 is positioned adjacent the front of hand gun 10 and ribs 92 aligned with and inserted into grooves 116 until the spring ball 98 snaps into its detent. To remove the punch assembly, pressure is exerted against the back of the stripper 108 and the ball snaps out of its detent 94. Joint quality is easily assured due to adjustability of punch 26. The punch assembly is removed from the gun, the set screw 120 loosened and the punch 26 rotated. Depending upon whether the punch is extended from or retracted into the punch holder, one rotational direction increases the joint diameter formed and the other rotational direction decreases the joint diameter formed. Once set correctly, the set screw is retightened to prevent further movement to punch 26 and the punch assembly 12 reinserted into the gun by simply snapping it into place.

Compressed air from the usual source is supplied through the filter-regulator-lubricator 22 to pressurize the trigger valve 100 on the gun and the resulting signal is routed to the power valve 220 to cause it to pressurize upper cylinder 190 when trigger 98 is pressed. The advancing booster piston 24 forces the hydraulic oil in supply chamber 200 through hose 40 and into chamber 50 thereby advancing gun piston 16. Oil hydraulic pressure is boosted to approximately 48 times the pressure of the air source, corresponding to the ratio of the area between the air piston and the hydraulic piston. Limit valve 240 is activated by the booster piston reaching the end of its stroke, starting timer 244 which maintains pressurization long enough to ensure complete formation of the joint. As punch 26 contacts the work piece (sheets "A" and "B"), stripper 108 clamps the metal sheets to die assembly 14 prior to punch penetration. The punch drives the metal into a cavity formed by the die blades. The joined metals are squeezed between the punch assembly and anvil causing an outward radial flow of metal to create a joint. On time-out the timer valve causes the power valve to retract booster piston 24 and spring 62 returns the gun piston. The pneumatic control valves and the plumbing thereof is in accordance with standard practices.

Figure 15:
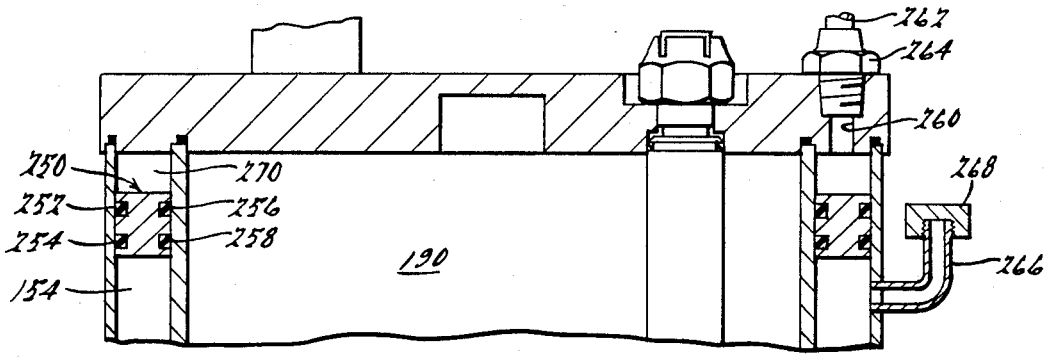
FIG. 15 is a fragmentary vertical section view of a portion of the apparatus of FIG. 13, showing a modification thereto.
Figure 13:
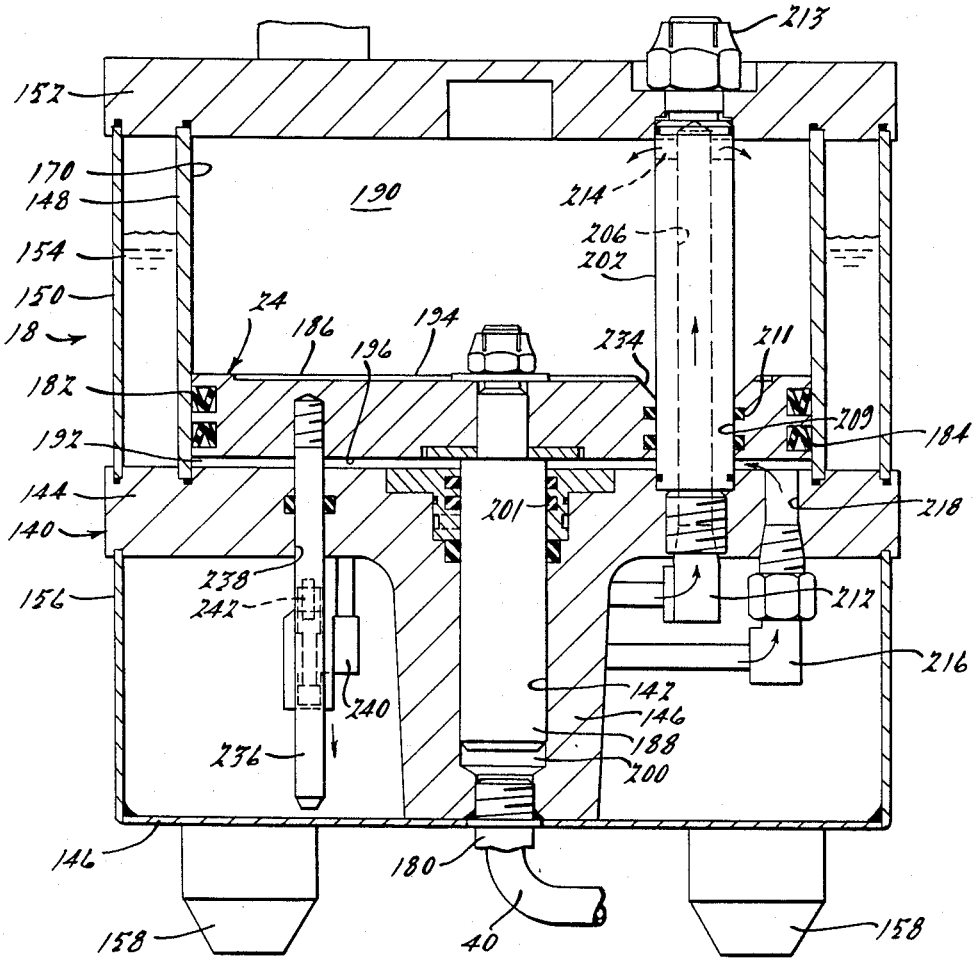
FIG. 13 is a section view of the booster taken along line 13—13 of FIG. 11.
Figure 14:
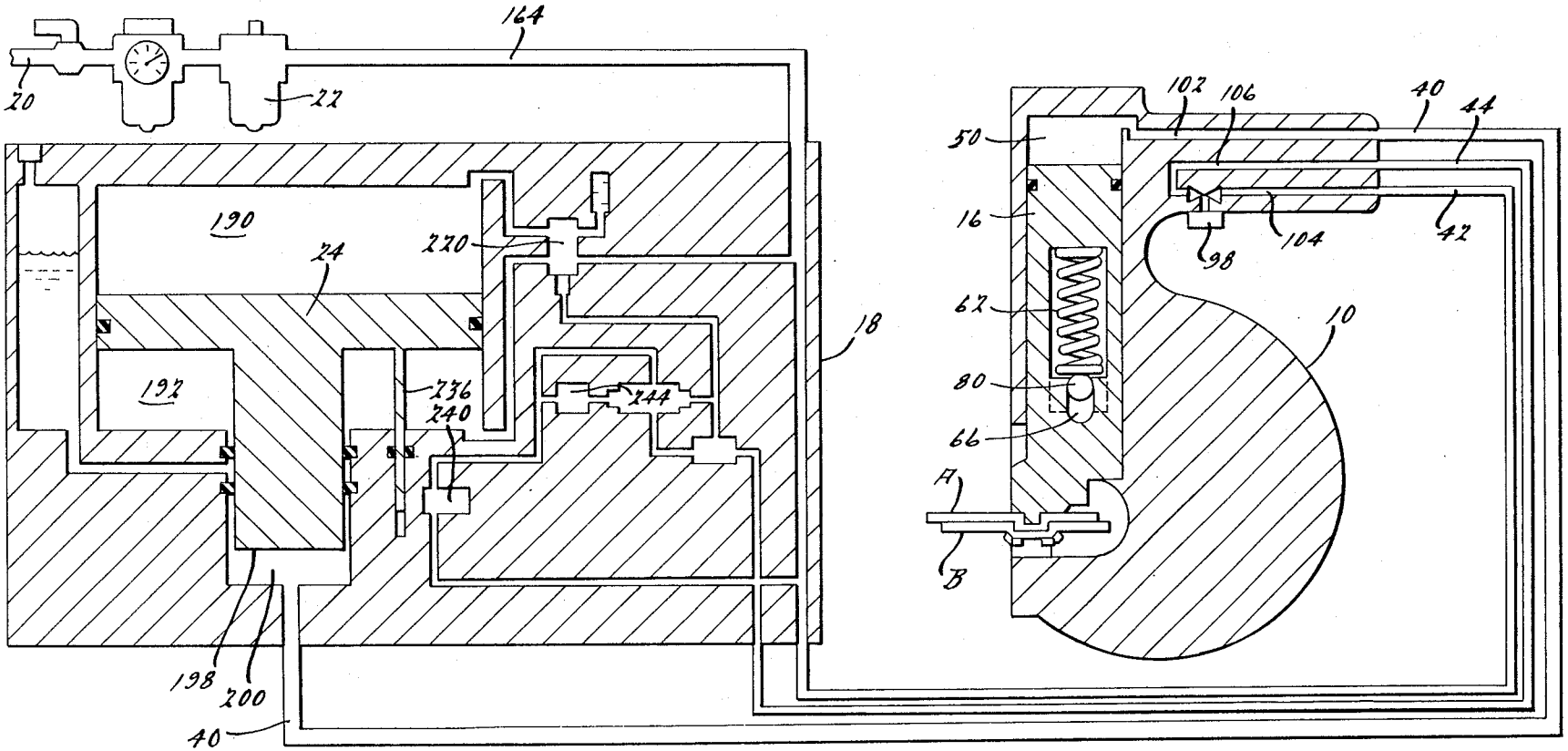
FIG. 14 is a schematic showing of the fluid circuit for the hand held sheet metal joining system.

In FIG. 15 there is shown a modified version of booster 100 which can provide a fast forward or advance cycle. The only differences between this embodiment and the one disclosed in FIGS. 1–14 is that there is provided an annular piston 250, having seals 252, 254, 256 and 258, sealingly disposed for vertical reciprocation in reservoir 154, an air inlet passageway 260 receiving air under pressure from a conduit 262 via a fitting 264, and a relocated oil filter tube 266 having a cap 268. With this arrangement a fast advance of the punch can be achieved by introducing pressurized compressed air above piston 250 through the filter-regulator-lubricator 22 to pressurize trigger 98 and through valve 220 to pressurize the lower booster cylinder 192. When the triger 98 is pressed conventional control logic supplies compressed air through passageway 260 to pressurize the oil reservoir 270. Hydraulic oil is forced through hose 40 to provide a rapid low pressure advance of gun piston 16. At this point the limit rod 236 or a pressure switch signals valve 220 to pressurize upper booster cylinder 190 and starts a timer. Oil hydraulic pressure is boosted to approximately 48 times the pressure of the air source and maintained long enough to form the joint whereupon valve 220 and the control logic reverse the pressure to return the booster piston 24 and gun piston 16.

While it is apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. An apparatus for joining two or more overlapping sheets of metal, comprising: a housing; a punch and die mounted in said housing, said punch and die being aligned on a center axis and normally spaced apart a sufficient distance to receive said sheets therebetween; a piston movably mounted in said housing for driving said punch along said axis towards said die and against the sheets whereby the sheets are joined; and a cartridge releasably connected to said piston for movement therewith, said punch being carried by said cartridge.

2. The apparatus as recited in claim 1, further comprising means for adjusting said punch relative to said cartridge.

3. The apparatus as recited in claim 1 wherein release of said cartridge from said piston is achieved by moving said cartridge in a direciton transverse to said axis.

4. The apparatus as recited in claim 1 including a spring loaded ball adapted to releasably interengage a detent for securing said cartridge to said piston, said ball depressing during movement of the cartridge with respect to said piston and snapping into said detent when brought in register therewith.

5. The apparatus as recited in claim 1 including rotation resisting means for preventing said piston from rotating relative to said housing.

6. The apparatus as recited in claim 5 wherein said rotation resisting means comprises an axial slot of predetermined length and location being adapted to receive a pin, said slot and pin being in one and the other of said piston and housing.

7. The apparatus as recited in claim 6 wherein said slot is in said piston and said pin is affixed to said housing.

8. The apparatus as recited in claim 7 wherein said pin and slot limit driving movement of said piston relative to said housing.

9. The apparatus as recited in claim 1 wherein said piston is powered by a fluid under pressure acting on a surface thereof, and said axis of said punch and die intersects said surface.

10. The apparatus as recited in claim 9 wherein said point of intersection is adjacent the periphery of said surface.

11. The apparatus as recited in claim 1 wherein said piston has a center axis parallel to and spaced from said center axis of said punch and die.

12. The apparatus as recited in claim 1 wherein said cartridge includes a stripper, means for connecting said stripper to said housing in axially spaced relation thereto, said means allowing axial movement of the stripper relative to said housing, and a coil spring biasing said housing and said stripper apart.

13. The apparatus as claimed in claim 1 wherein said piston has a pair of generally parallel transverse support surfaces and said cartridge has a complimentary pair of mounting surfaces in supporting engagement therewith for distributing punch driving loads.

14. The apparatus as recited in claim 13 wherein said center axis of said punch and die and the center axis of said piston are disposed between said support surfaces and between said mounting surfaces such that tilting moments of said punch and die and said piston are reduced.

15. The apparatus as claimed in claim 13 wherein said support surfaces are disposed on parallel opposed ribs on said piston and said mounting surfaces are disposed on parallel slots on said cartridge.

16. A fluid machine comprising: a cylinder; a first end plate sealingly disposed at one end of said cylinder; a second end plate sealingly disposed at the other end of said cylinder, said end plates and cylinder defining a fluid chamber; a piston mounted for reciprocation in said chamber; and a plurality of connectors interconnecting said end plates for clamping said cylinder therebetween against the pressure of fluid in said chamber, at least one of said connectors being tubular and providing a fluid passage between said end plates.

17. A fluid machine as claimed in claim 16 wherein a second one of said connectors is tubular and provides a fluid passage.

18. A fluid machine as claimed in claim 17, wherein said second connector provides a fluid passage from one of said end plates to said chamber on the end of said piston opposite said one end plate.

19. A fluid machine as claimed in claim 18 wherein said second connector extends through said piston.

20. A fluid machine as claimed in claim 16 wherein said one connector threadably engages one of said end plates, and extends through the other of said end plates and is secured thereto.

21. A fluid machine as claimed in claim 20 wherein said securing is by threaded means.

22. A fluid machine as claimed in claim 16 wherein said one connector provides a fluid pasage from one of said end plates to said chamber on an end of said piston opposite said one end plate.

23. A fluid machine as claimed in claim 22 wherein said one connector extends through said piston.

24. A fluid machine as claimed in claim 23 further comprising a fluid seal between said piston and connector to prevent leakage from one end of said piston to the other as it reciprocates with respect to said connector.

25. A fluid machine as claimed in claim 16 wherein each of said plates has an annular groove on a face thereof in which said cylinder is sealingly disposed.

26. A fluid machine as claimed in claim 16 further comprising a second larger cylinder surrounding said first-mentioned cylinder and sealingly engaging both of said end plates, whereby an annular reservoir is defined between said cylinders.

27. A fluid machine as claimed in claim 26 wherein each of said end plates has a pair of annular grooves as a face thereof in which said cylinders are respectively sealingly disposed.

28. A portable apparatus for joining sheet metal comprising: hydraulically powered hand held punch means having tools for creating a sheet metal joint; a pneumatically powered intensifier for providing a hydraulic fluid at relatively high pressures; means on said intensifier for connecting same to a standard source of compressed air; tube means for communicating hydraulic fluid from said intensifier to said punch means; control means associated with said intensifier for controlling the supply of hydraulic fluid; and trigger means on said punch means for controlling the action of said controlling means.

29. The portable apparatus as claimed in claim 28 including a pneumatically powered piston connected to said compressed air for pressurizing said hydraulic fluid.

30. The portable apparatus as claimed in claim 29 including a pair of concentrically disposed cylindrical shells, a pair of end plates one and the other plate sealingly closing one end of said shells to define an annular fluid chamber concentrically disposed about a central fluid chamber, the penumatically powered piston being disposed for vertical movement within said annular fluid chamber nd the intensifier being disposed in said central fluid chamber.

* * * * *

UNITED STATES PATENT AND TRADEMARK OFFICE

CERTIFICATE OF CORRECTION

PATENT NO. : 4,878,284

DATED : November 7, 1989

INVENTOR(S) : Edwin G. Sawdon

It is certified that error appears in the above-identified patent and that said Letters Patent is hereby corrected as shown below:

Column 1, line 15, "sheet" should be -- sheets --.

Column 1, line 17, delete "an".

Column 2, line 27, "enter" should be -- center --.

Column 4, line 12, "dies" should be -- die --.

Column 5, line 65, "pasasge" should be -- passage --.

Column 5, lines 67, 68, 69,70, after "209" delete -- in chamber 200. A recess 234 is disposed in upper surface 194 about bore 209 --.

Column 6, line 36, "to" should be -- of --.(2nd occurrence)

Column 7, line 10, "triger" should be -- trigger --.

Column 7, line 44, Claim 3, "direciton" should be -- direction --.

UNITED STATES PATENT AND TRADEMARK OFFICE

CERTIFICATE OF CORRECTION

PATENT NO. : 4,878,284

DATED : November 7, 1989

INVENTOR(S) : Edwin G. Sawdon

It is certified that error appears in the above-identified patent and that said Letters Patent is hereby corrected as shown below:

Column 8, line 54, Claim 22, "pasage" should be -- passage --.

Column 10, line 14, Claim 30, "nd" should be -- and --.

Signed and Sealed this

Second Day of July, 1991

*Attest:*

*Attesting Officer*

HARRY F. MANBECK, JR.

*Commissioner of Patents and Trademarks*